US006951295B1

(12) United States Patent
Gaus et al.

(10) Patent No.: US 6,951,295 B1
(45) Date of Patent: Oct. 4, 2005

(54) FLOW CONTROL ELEMENT AND DISPENSING STRUCTURE INCORPORATING SAME

(75) Inventors: David J. Gaus, Saginaw, MI (US); Gregory M. Olechowski, Rhodes, MI (US); Timothy R. Socier, Essexville, MI (US); John M. Hess, III, Midland, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 11/038,638

(22) Filed: Jan. 18, 2005

(51) Int. Cl.[7] ..... B67D 3/00
(52) U.S. Cl. ..... 222/484; 222/494
(58) Field of Search ..... 222/212, 481.5, 222/482, 484, 494

(56) References Cited

U.S. PATENT DOCUMENTS

| | | | | |
|---|---|---|---|---|
| 4,513,891 | A | 4/1985 | Hain et al. | |
| 4,646,945 | A | 3/1987 | Steiner et al. | |
| 4,760,937 | A | 8/1988 | Evezich | |
| 4,946,062 | A | 8/1990 | Coy | |
| 5,005,737 | A | 4/1991 | Rohr | |
| 5,033,655 | A | 7/1991 | Brown | |
| 5,169,035 | A | 12/1992 | Imbery, Jr. | |
| 5,409,144 | A | 4/1995 | Brown | |
| 5,472,122 | A * | 12/1995 | Appleby | 222/494 |
| 6,050,445 | A | 4/2000 | Manganiello | |
| 6,062,436 | A | 5/2000 | Fuchs | |
| 6,102,245 | A | 8/2000 | Haberman | |
| RE37,016 | E | 1/2001 | Morano | |
| 6,230,940 | B1 | 5/2001 | Manning et al. | |
| 6,250,503 | B1 | 6/2001 | Dark | |
| 6,298,554 | B1 | 10/2001 | Fuchs | |
| 6,341,721 | B1 | 1/2002 | Herald et al. | |
| 6,749,092 | B2 | 6/2004 | Olechowski et al. | |
| 6,874,656 | B2 * | 4/2005 | Rohr et al. | 222/494 |

FOREIGN PATENT DOCUMENTS

| | | |
|---|---|---|
| GB | 2169210 A | 7/1986 |
| GB | 2266045 A | 10/1993 |

* cited by examiner

*Primary Examiner*—Philippe Derakshani
(74) *Attorney, Agent, or Firm*—Wood, Phillips, Katz, Clark & Mortimer

(57) ABSTRACT

A flow control element is provided with a resilient sealing flange biased to seal in-venting passages in a housing around the element. The element also includes a self-sealing, pressure-openable, dispensing valve. The element and housing can be combined to form a dispensing structure that can function to discharge a fluent material product out of the dispensing structure through the dispensing valve while simultaneously venting exterior ambient air (or other exterior ambient environment fluent material) into the dispensing structure.

11 Claims, 12 Drawing Sheets

FLOW CONTROL ELEMENT AND DISPENSING STRUCTURE INCORPORATING SAME

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a dispensing system for dispensing a fluent material product from a supply system that may include a container or other source of the fluent material product and that may include a pump. The invention is particularly suitable for incorporation in a supply system that includes a pump, and is also especially suitable for incorporation in a dispensing closure for use with a squeezable container that does not include a pump.

BACKGROUND OF THE INVENTION AND TECHNICAL PROBLEMS POSED BY THE PRIOR ART

A variety of dispensing systems have been developed for dispensing a fluent material product, such as pharmaceutical fluids, beverages, and personal care products such as soap, from a supply system. Such a supply system (which could be, or include, a container) typically has a discharge end that includes a dispensing end structure which may be a unitary part of the supply system or a separate closure that is releasably or permanently mounted to the container or other supply system.

One type of conventional dispensing end structure used with containers has a flow control element in the form of a flexible, pressure-openable, self-sealing, slit-type dispensing valve mounted in the end structure over the container opening. The term "pressure-openable refers to a valve which opens when a sufficient pressure differential is applied across the valve (e.g., as by increasing the pressure on one side and/or decreasing the pressure on the other side). Such a valve is typically used on a container which has a flexible, but resilient, wall or walls. When the container is squeezed, the pressure inside the container increases. This causes the valve slit or slits to open, and the fluent material product contents of the container are discharged through the open valve. Typically, the valve automatically closes to shut off fluid flow upon removal of the increased pressure—even if the container is inverted and the closed valve is subject to the weight of the contents within the container. Designs of such valves are illustrated in the U.S. Pat. Nos. 5,271,531, 5,033,655, and 4,931,775.

When a separate dispensing closure is employed for attachment to the container, the closure typically includes a body mounted on the container to hold the valve over the container opening. A lid can be provided for engaging the closure body to cover the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt away from the valve and/or can protect the valve from damage.

The inventors of the present invention have determined that it would be advantageous to provide a new type of flow control element for use in, or as part of, a dispensing structure or closure that can provide certain operational advantages. It would be particularly beneficial to provide such an improved flow control element with the capability for dispensing a fluent material product while at the same time accommodating in-venting of another (e.g., second) fluent material (e.g., ambient air) into the container or other supply system so as to minimize or eliminate interruption of the discharging flow of the fluent material product.

Such an improved flow control element should preferably also have the capability of creating a seal between the surrounding environment (e.g., atmosphere) and the product when the flow control element is closed so as to protect the fluent material product from contamination and/or dehydration.

Further, it would be beneficial if such an improved flow control element could function as a part of a closure or other dispensing structure that does not necessarily require the use of a lid.

It would also be desirable to provide a flow control element that could be incorporated in a dispensing closure for the package (e.g., the package consisting of a container, product in the container, and the dispensing end structure on the container) and that would permit the user to invert the package without product leakage prior to dispensing, thereby providing the user with more control over the product dispensing operation.

It would also be desirable if such an improved flow control element could be readily retained in a closure that could optionally accommodate the employment of an auxiliary lid and/or frangible, tamper-evident cover or tear band.

An improved flow control element should also accommodate designs which permit incorporation of the element as a unitary part, or extension, of the container (or other supply system), as well as designs that separately mount the dispensing structure or closure on the container (or other supply system) in a removable or non-removable manner.

It would also be beneficial if such an improved flow control element, either alone or as part of a dispensing structure, could readily accommodate its manufacture from a variety of different materials.

Further, it would be desirable if such an improved flow control element, and any associated dispensing end structure incorporating the element, could be provided with a design that would accommodate efficient, high-quality, large volume manufacturing techniques with a reduced product reject rate.

Preferably, the design of the improved flow control element and dispensing structure should also accommodate high-speed manufacturing techniques that can produce products with consistent operating characteristics unit-to-unit with high reliability.

The present invention provides an improved flow control element and associated dispensing structure which can accommodate designs having one or more of the above-discussed benefits and features.

BRIEF SUMMARY OF THE INVENTION

According to one aspect of the present invention, a flow control element is provided for discharging fluent material contents from a supply system, especially a fluent material product from the interior of a container, while accommodating the simultaneous in-venting of another (e.g., second) fluent material (e.g., ambient air). The flow control element is preferably self-sealing after the termination of the discharge of the fluent material product.

The flow control element is provided for operatively cooperating with a housing, as by being mounted within a housing, such as a closure or other supply system, to discharge a fluent material product to the housing exterior while venting another (e.g., second) fluent material (e.g., ambient air) from the exterior of the housing through a vent passage into the housing interior. The flow control element includes a stationary anchor portion (which could be a mounting hub or mounting flange) which extends around a discharge region. A deflectable sealing flange extends laterally from and around the stationary anchor portion. The sealing flange defines a sealing surface facing generally in the direction away from the interior of the housing when the flow control element is in operative cooperation with the housing. The sealing flange is adapted to be resiliently biased for sealingly contacting a part of the housing to prevent discharge of the fluent material product through a vent passage when the flow control element is in cooperation with the housing. A flexible, pressure-openable, self-sealing, slit-type valve is connected to the stationary anchor portion and is located across the discharge region. The valve is normally closed to prevent discharge of the fluent material product. When the flow control element is in operative cooperation with the housing, the valve can open in response to a pressure differential to permit the discharge of the fluent material product through the valve while the sealing flange can be deflected by a pressure differential toward the interior of the housing and away from the housing vent passage so as to permit in-venting during the product discharge.

In accordance with another aspect of the invention, the flow control element is provided in combination with a housing to define a dispensing structure. The housing has a discharge opening and has at least one in-venting passage laterally beyond the discharge opening. The flow control element is disposed across the housing discharge opening so that the discharge region of the flow control element can communicate with the housing discharge opening and so that the sealing flange is biased against the housing laterally outwardly of the in-venting passage or passages. When the fluent material product is discharging through the open valve and out of the housing discharge opening, the sealing flange can be forced away from its sealing engagement with the housing if the pressure inside the housing decreases sufficiently relative to the pressure of the exterior environment (e.g., ambient air), and then exterior ambient fluent material (e.g., ambient air) will be permitted to vent into the housing past the sealing flange.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 12 shows the flow control element in the normally closed configuration;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, various embodiments of components of this invention are described in certain orientations. It will be understood, however, that the components of this invention may be manufactured, stored, transported, used, and sold in orientations other than those described.

The flow control element of this invention and the inventive dispensing structure incorporating the flow control element are suitable for use with a variety of conventional or special fluent material supply systems (including containers) having various designs, the details of which, although not illustrated or described, would be apparent to those having skill in the art and an understanding of such supply systems.

With respect to the illustrated embodiments of the invention described herein, the container or other supply system, per se, forms no part of, and therefore is not intended to limit, the broadest aspects of the present invention. It will also be understood by those of ordinary skill that novel and unobvious inventive aspects are embodied in the described exemplary flow control elements alone, and also in the flow control elements in combination with the described exemplary dispensing structures incorporating such flow control elements.

Figure 5:
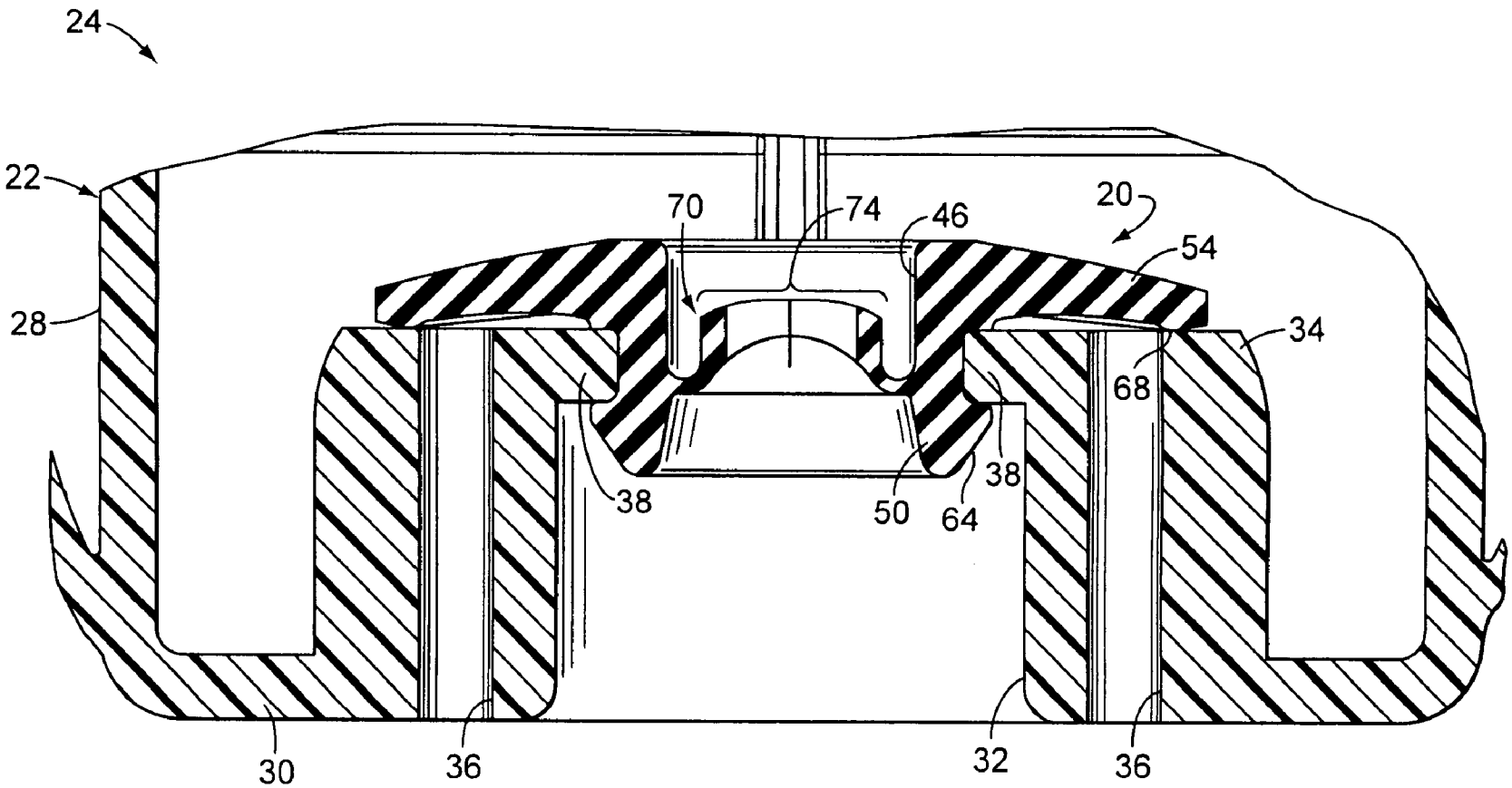
FIG. 5 is a fragmentary, cross-sectional view of a dispensing end structure that is part of a fluent material supply system and that incorporates the first embodiment of the flow control element illustrated in FIGS. 1–4, the flow control element in FIG. 5 being shown in a closed configuration wherein a fluent material product is not being dispensed through the flow control element and wherein another (e.g., second) fluent material in the exterior environment (e.g., ambient air) is not flowing past the flow control element into the interior of the dispensing end structure.
Figure 6:
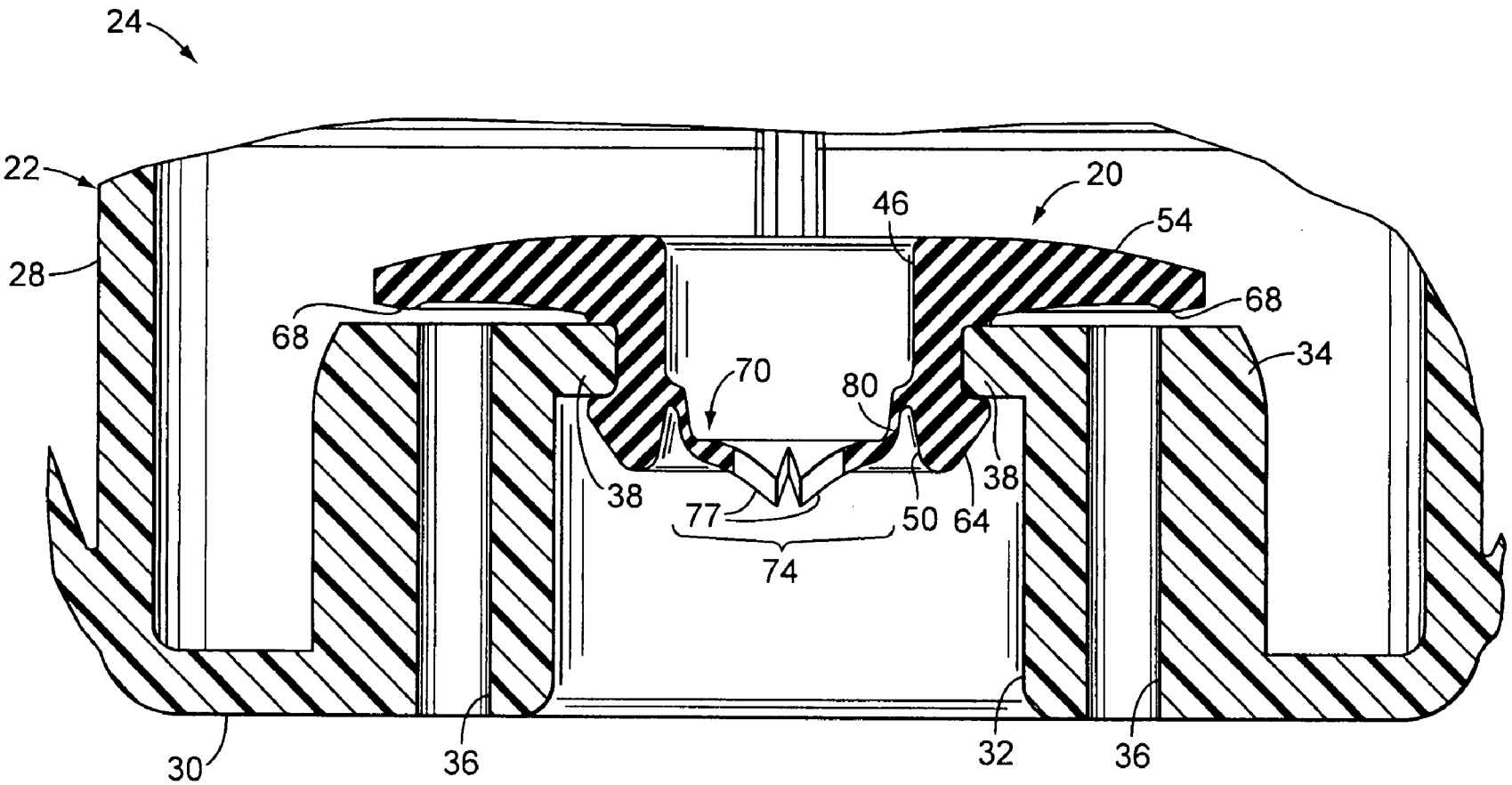
FIG. 6 is a view similar to FIG. 5, but FIG. 6 shows the flow control element in an open configuration for dispensing the fluent material product (not shown) and for permitting the in-venting flow of exterior ambient air into the interior of the dispensing end structure.

A first embodiment of a flow control element 20 of the present invention is illustrated in FIGS. 1–4. FIGS. 5–6 show the flow control element 20 mounted in a housing 22 to form a first embodiment of a dispensing structure 24 of the present invention which accommodates the discharge of a fluent material product (not shown) at the same time it accommodates in-venting of ambient air (or other fluent material from the exterior ambient environment) into the dispensing structure 24 as described in detail hereinafter.

In the presently preferred, first embodiment illustrated in FIGS. 1–4, the flow control element 20 is of unitary construction and made from a suitable, flexible, resilient material. The flow control element 20 is preferably molded from an elastomer, such as a synthetic thermosetting polymer, including silicone rubber, such as the silicone rubber sold by Dow Corning Corp. in the United States of America under the trade designation DC 94-595HC. However, the flow control element 20 can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

The first embodiment of the dispensing structure 24 of the present invention is in the form of a dispensing closure illustrated in FIGS. 5 and 6, and is hereinafter sometimes referred to more simply as the "closure 24." It is provided as a separately manufactured unit or subassembly for mounting to a supply system or source of fluent material product that is to be discharged. Such a supply system may be a container (not shown). In FIGS. 5 and 6, the closure 24 is shown in an orientation that the closure 24 would have on an inverted container positioned for discharging a fluent material product downwardly. In some applications it may be desirable for the closure 24 to be formed as a unitary part, or extension, of the container wherein the unitary part or extension defines a dispensing end structure of the supply system (e.g., container), per se.

The container (not shown) typically may have a conventional mouth which provides access to the container interior and fluent material product contained therein. The product may be, for example, a fluid or flowable product, such as liquid hand soap, mustard, ketchup, etc. The product could also be any other fluent material, including, but not limited to, powders, creams, lotions, slurries, pastes, etc. Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container (not shown) typically may have a neck or other suitable structure defining the container mouth. The neck may have (but need not have) a circular cross-sectional configuration, and the body of the container may have another cross-sectional configuration, such as an oval cross-sectional shape, for example. The container may, on the other hand, have a substantially uniform shape along its entire length or height without any neck portion of reduced size or different cross-section.

The container may be a squeezable container having a flexible wall or walls which can be grasped by the user and compressed to increase the internal pressure within the container so as to squeeze the product out of the container through the closure (or other dispensing structure) 24 when the closure 24 is open. Such a container wall typically has sufficient, inherent resiliency so that when the squeezing forces are removed, the container wall tends to return to its normal, unstressed shape, and tends to draw ambient fluent material (which may be a gas such as air, or may be other exterior fluent material in the environment surrounding the container) into the container through the closure to the extent that the closure is an open mode or in-venting mode. Such a squeezable container structure is preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the product under the influence of gravity acting on the mass of the discharging product and/or under the influence of a reduced ambient pressure at the exterior of the container (e.g., as created by sucking on the open closure 24 or by applying a partial vacuum with a pump (not illustrated) connected to the discharge end of the closure 24).

The closure 24 need not be a structure that is completely separate from the container. Instead, the container, per se, could be made with a dispensing end structure that incorporates the body 22 as a unitary part of the container. In such an alternative, the body 22 may be characterized as a structural feature that functions to accommodate communication with the container interior. In such an alternative design, the container may have a base end (i.e., the end opposite the dispensing end on which the closure 24 is located), and the container could be made with that base end initially left open for accommodating the filling of the inverted container with the fluent material product to be dispensed. After the inverted container is filled with the product through the open base end of the container, the open base end of the container could be closed by suitable means, such as by a separate base end closure which could be attached to the container base end through a suitable threaded engagement, snap-fit engagement, adhesive engagement, thermal bonding engagement, etc. Alternatively, such an open base portion of the container could be deformed closed (e.g., with an appropriate process applying heat and force if the container base portion is made from a thermoplastic material or other material that would accommodate the use of such a process).

The closure body 22 may have a skirt 28 (FIGS. 5 and 6) with a conventional internal thread (not shown) for engaging a mating container thread (not shown) to secure the closure body 22 to the container (not shown). The closure body 22 and container could also be releasably connected with a snap-fit bead and groove (not shown), or by other means. Alternatively, the closure body 22 may be permanently attached to the container by means of induction bonding, ultrasonic bonding, gluing, or the like, depending upon the materials employed for the container and closure body 22. The interior of the body 22 may include special or conventional seal features to provide an enhanced leak-tight seal between the closure body 22 and the container.

The illustrated preferred, first form of the closure body 22 defines a radially inwardly extending deck 30 (FIGS. 5 and 6). The deck 30 defines a central dispensing opening 32. An annular portion of the deck 30 around the opening 32 extends axially inwardly to define an annular wall 34. The annular wall 34 defines one or more vent passages 36 extending from the exterior surface of the deck 30 to the interior of the closure body 22. At the axially inner end of the annular wall 34, there is a radially inwardly projecting annular flange 38 on which the full control element 20 is mounted.

In the embodiment illustrated in FIGS. 5 and 6, there are two passages 36 which are visible, and each passage 36 is a generally cylindrical bore. In a typical, preferred configuration, three or more passages 36 are defined in the annular wall 34 and are uniformly spaced-apart on a circular locus.

In some applications, it may be desirable to provide an in-line pump (not shown) that is in communication with the closure body discharge opening 32, and that would draw a reduced pressure in the discharge opening 32. The connection of such an in-line pump to the closure body discharge opening 32 would not interfere with the outwardly located vent passages 36 which would remain free and unobstructed to communicate with the exterior ambient environment adjacent the exterior surface of the closure body deck 30.

Figure 1:
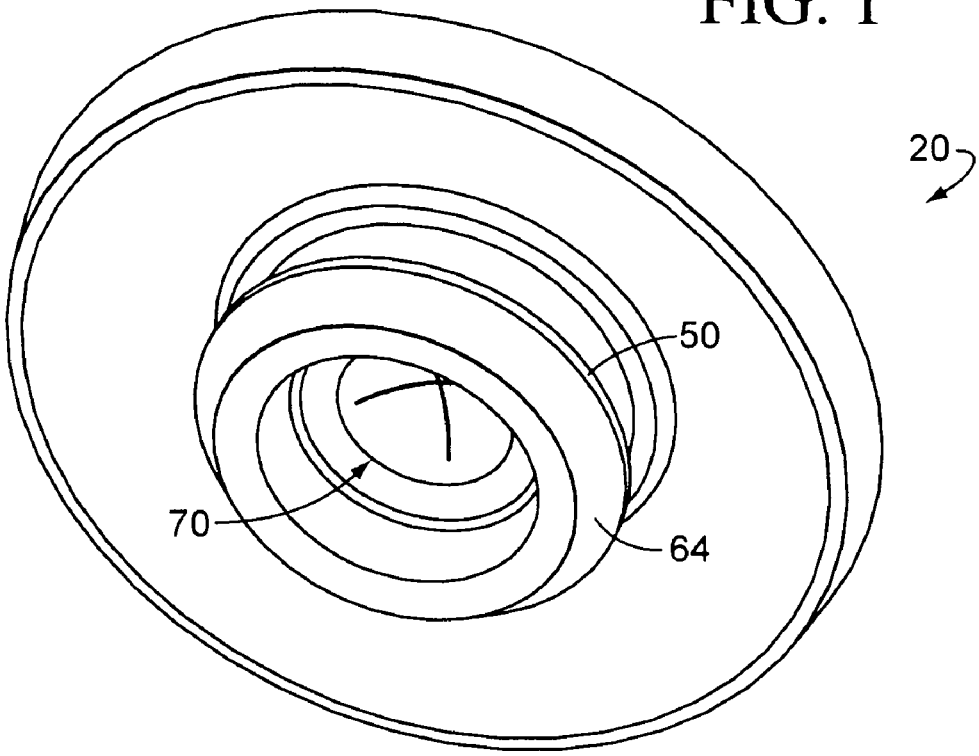
FIG. 1 is a perspective view of the exterior face of a first embodiment of the flow control element of the present invention.
Figure 2:
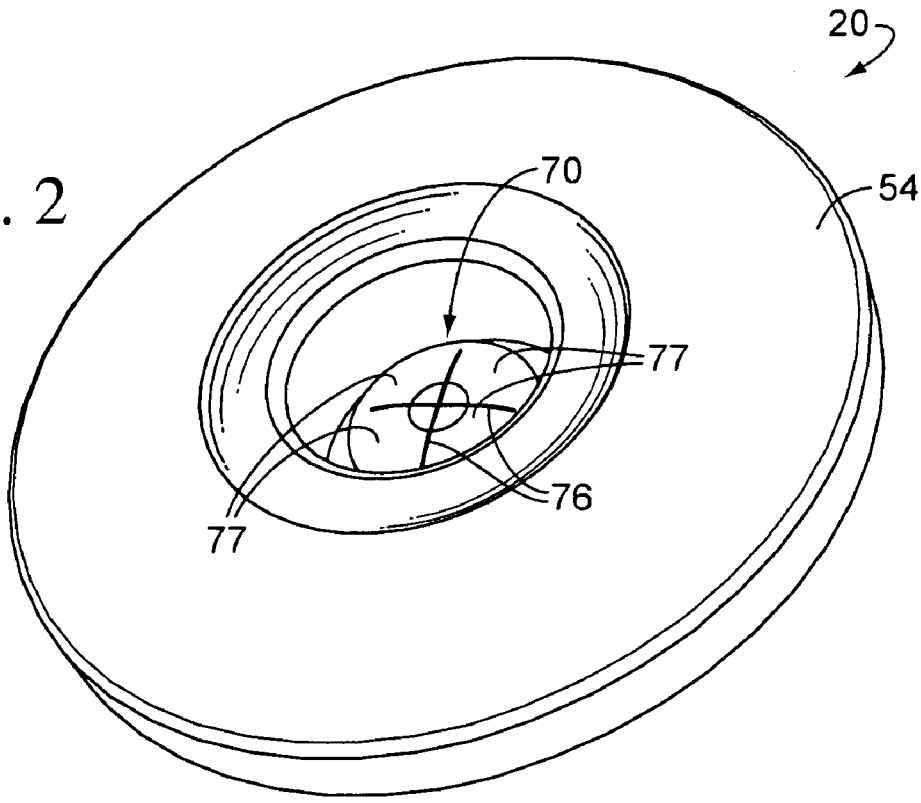
FIG. 2 is a perspective view of the interior face of the first embodiment of the flow control element shown in FIG. 1.
Figure 3:
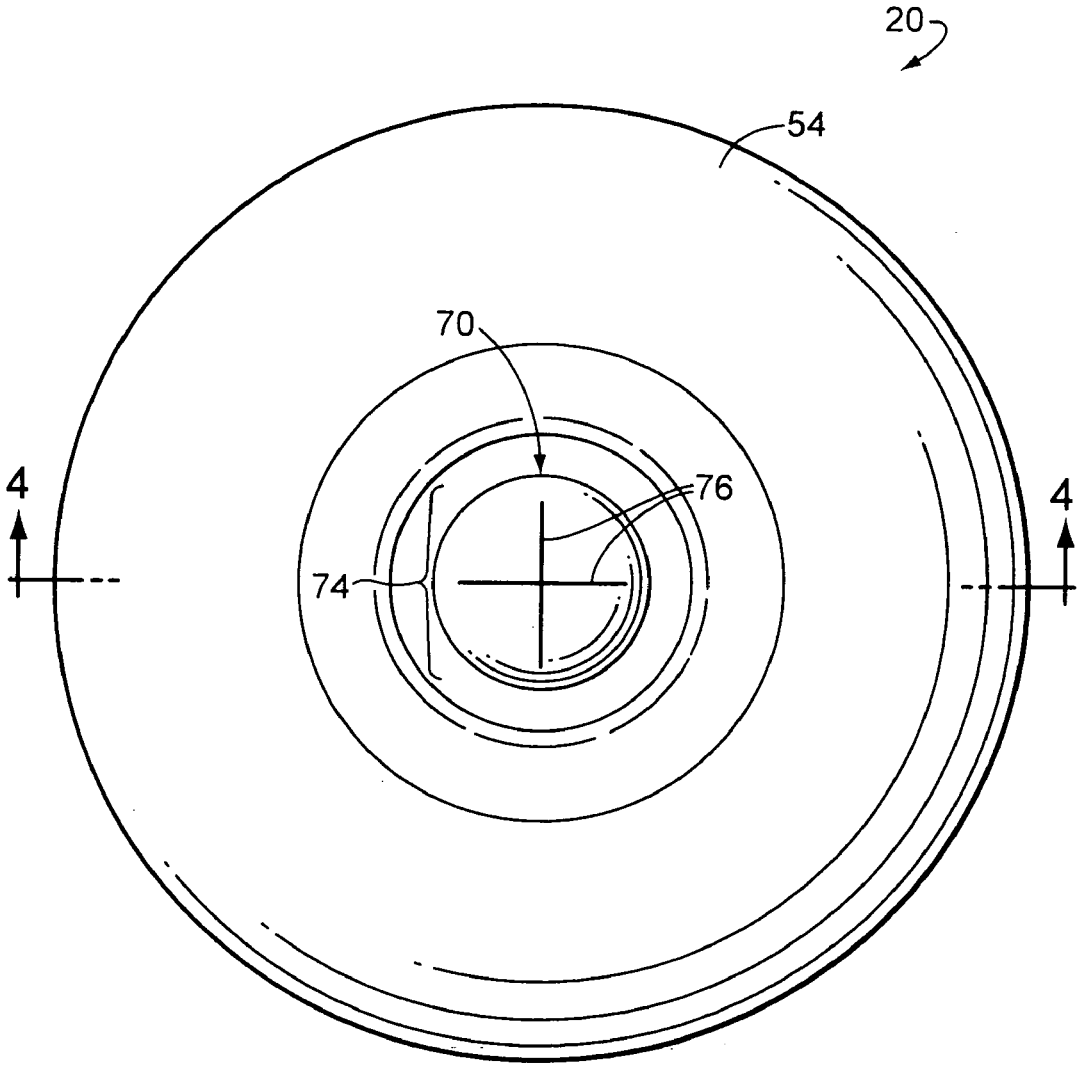
FIG. 3 is a plan view of the interior face of the flow control element shown in FIGS. 1 and 2.
Figure 4:
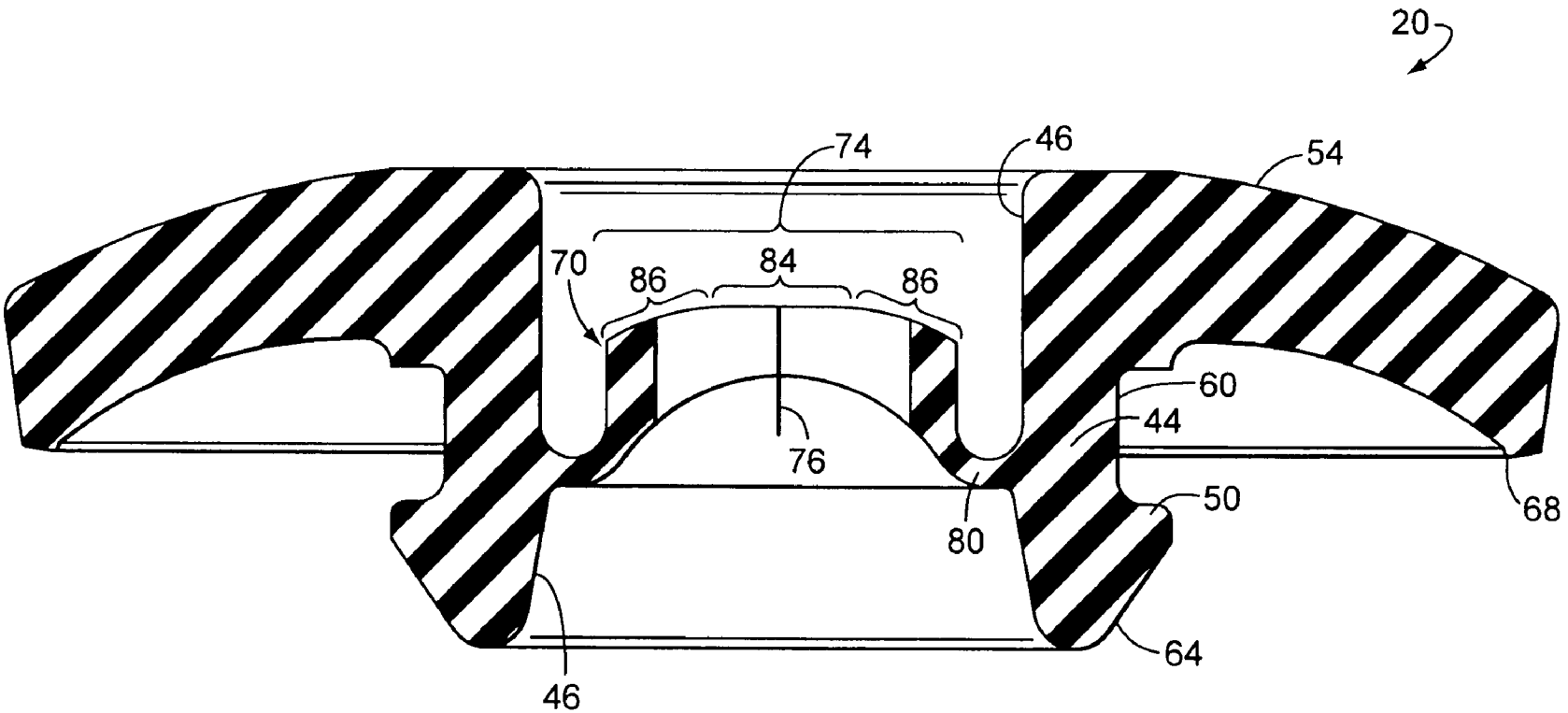
FIG. 4 is an enlarged, cross-sectional view taken generally along the plane 4—4 in FIG. 3.

As can be seen in FIG. 4, the flow control element 20 has a central, stationary anchor portion 44, which, in the preferred embodiment, is in the form of a generally annular hub 44 that extends around, or defines, a discharge region or discharge passage 46 (FIG. 4). The hub 44 has a radially outwardly extending retention flange 50 (on the exterior end of the hub 44), and has a radially outwardly extending, umbrella-shaped, sealing flange 54 (on the interior end of the hub 44). The exterior end retention flange 50 cooperates with a radially inner portion of the sealing flange 54 to define an annular mounting groove 60 for receiving the closure body mounting flange 38 as shown in FIGS. 5 and 6.

To assist in installation of the flow control element 20 onto the closure body mounting flange 38, the distal portion of the flow control element exterior retention flange 50 has an angled or frustoconical-conical surface 64 (FIG. 4). If the flow control element 20 is molded from a flexible, resilient material, such as silicone, then, during installation of the flow control element 20 on the closure body mounting flange 38, the retention flange 50 and an adjacent portion of the hub 44 can undergo deformation as necessary to permit the retention flange 50 to pass through the opening defined by the closure body retention mounting flange 38.

When the flow control element 20 is properly installed on the closure body mounting flange 38 as shown in FIG. 5, the outer end portion of the flow control element sealing flange 54 is bent or deformed slightly(upwardly as viewed in FIG. 5) away from the normal, as-molded configuration (FIG. 4), and the peripheral portion of the sealing flange 54 sealingly contacts the closure body annular wall 34 radially outwardly of the vent passages 36. The sealing contact of the flow control element sealing flange 54 with the closure body annular wall 34 is an annular region of contact. This contact occurs between the interior, flat, end surface of the closure body annular wall 34 and a small annular surface portion 68 (FIGS. 4 and 6) of the flow control element sealing flange 54. In a presently contemplated, preferred form of the invention, the surface 68 includes a flat area. However, the surface 68 could have other suitable surface configurations. The configuration of the flow control element sealing flange 54 and the resilient nature of the material from which the flow control element 20 is made results in the sealing flange 54 being normally biased against, and in sealing contact with, the closure body annular wall 34 so as to normally prevent the exterior ambient air (or any other surrounding environmental fluent material) from flowing past the flow control element 20 into the interior of the closure body 22.

The central region of the flow control element 20 includes a flexible, pressure-openable, self-sealing, slit-type dispensing valve 70 (FIGS. 2 and 4) which, in the preferred embodiment, is molded as a unitary part of the flow control element 20. The valve 70 has an interior side for facing generally toward the closure body 22, and the vale 70 has an exterior side for facing generally outwardly from the closure body 22. The interior side of the valve 70 is adapted to be contacted by the fluent material product, and the exterior side of the valve 70 is exposed to the ambient external environment or to an in-line pump (not shown).

The design configuration of the valve 70, and the operating characteristics thereof, are substantially similar to the configuration and operating characteristics of the valve designated by the reference number 3d in the U.S. Pat. No. 5,409,144. The description in that patent is incorporated herein by reference to the extent pertinent and to the extent not inconsistent herewith.

As illustrated in FIG. 4 herein, the valve 70 includes a head or head portion 74 which is flexible and which has an outwardly concave configuration (as viewed from the exterior of the valve 70 when the valve 70 is mounted in the closure body 22 (FIG. 5)). The head 74 defines at least one, and preferably two, dispensing slits 76 extending through the head 74 to define a normally closed, self-sealing orifice. The preferred form of the valve 70 has two, mutually perpendicular, intersecting slits 76 of equal length.

With reference to FIG. 4, the interior side of the valve head 74 includes a circular, central, flat surface 84 and a peripheral, curved surface 86 around the central flat surface 84. The slits 76 extend laterally from the valve head central, flat surface 84 into the valve head peripheral, curved surface 86. The intersecting slits 76 define four, generally sector-shaped, flaps or petals 77 (FIG. 2) in the head 74. The flaps 77 open outwardly (FIG. 6) from the intersection point of the slits 76 in response to an increasing pressure differential of sufficient magnitude in the manner described in the above-discussed U.S. Pat. No. 5,409,144.

The valve 70 includes a thin skirt 80 (FIG. 4) which extends axially and radially outwardly from the valve head 74. The outer end portion of the skirt 80 is connected in a unitary manner with the flow control element hub 44.

When the valve 70 is properly mounted in the closure body 22 (FIGS. 5 and 6) with the valve head 74 in the closed condition, the valve 70 is recessed relative to the exterior retention flange 50. However, when the head 74 is forced outwardly from its recessed position by a sufficiently large pressure differential, the valve head 74 opens as shown in FIG. 6. More specifically, when the pressure on the interior side of the valve 70 exceeds the external pressure by a predetermined amount, the valve head 74 is forced outwardly from the recessed or retracted position to an extended, open position as shown in FIG. 6.

During the valve opening process, the valve head 74 is initially displaced outwardly while still maintaining in its generally concave, closed configuration. The initial outward displacement of the concave head 74 is accommodated by the relatively, thin, flexible, skirt 80. The skirt 80 moves from a recessed, rest position to the pressurized position wherein the skirt 80 extends outwardly toward the open end of the closure body 22. However, the valve 70 does not open (i.e., the slits 76 do not open) until the valve head 74 has moved substantially all the way to a fully extended position (FIG. 6). Indeed, as the valve head 74 moves outwardly, the valve head 74 is subjected to radially inwardly directed compression forces which tend to further resist opening of the slits 76. Further, the valve head 74 generally retains its outwardly concave configuration as it moves forward, and even after the sleeve 80 reaches the fully extended position. However, when the internal pressure becomes sufficiently great compared to the external pressure, the slits 76 in the extended valve head 74 open to dispense the fluent material product.

According to one mode of operation for which the flow control element 20 is especially suitable, a reduced pressure is drawn at the closure body opening 32 (FIG. 5) on the exterior of the flow control element 20. In one contemplated application for this invention, such a reduced pressure is drawn by an in-line pump (not shown) connected to the closure body opening 32 (but not connected to the radially outward vent passages 36). When the reduced pressure is drawn by operation of such an in-line pump (not shown), the pressure on the exterior side of the valve head 74 is reduced compared to the pressure on the other side of the valve head 74 inside the closure body 22 which is connected to the container of fluent material product. The resulting pressure differential, when great enough, causes the valve head 74 to open as shown in FIG. 6 (and as explained in detail above). In other contemplated embodiments, a spout adapted for insertion into the user's mouth could be mounted to exterior of the closure body 22 in sealed communication with the closure body opening 32. When the user sucks on such a spout with sufficient force, the valve head 74 opens as shown in FIG. 6.

When the valve head 74 opens, the fluent material product discharges through the valve 70, and this may cause a lowering of the pressure within the interior of the closure body 22 (and container attached thereto) as the fluent material product leaves the interior volume of the container and closure body 22. The discharging flow of the fluent material product through the valve 70 may be interrupted or inhibited if such lower pressure occurs in the closure body 22. However, if the interior pressure becomes sufficiently lower than the pressure of the exterior, ambient environment, then the exterior fluent material (e.g., ambient atmospheric air) will flow through the in-vent passages 36 against the flow control element sealing flange 54 and overcome the bias of the flange 54 against the end of the closure body annular wall 34. The flange 54 will be forced upwardly by the pressure differential to the position illustrated in FIG. 6, and exterior ambient fluent material (e.g., ambient air) will be permitted to flow through the vent passages 36 into the interior of the closure body 22 for communicating with the interior of the container (not shown). This will permit the incoming ambient fluent material (e.g., air) to occupy the interior volume previously occupied by the discharging fluent material product. This in-venting can occur during the discharge of the fluent material product, although the fluent material product may discharge for a longer period of time than the length of time during which the flange 54 is in the open position and ambient air (or other exterior ambient fluent material) is venting into the closure body 22. As a result of the in-venting of the fluent material from the exterior ambient environment (e.g., air), the discharge of the fluent material product may flow out in a more steady discharge stream and is less likely to be temporarily interrupted.

The flow control element flange 54 will close when the pressure differential across the flange 54 is no longer great enough to force the flange 54 upwardly away from the vent passages 36. When the pressure differential across the valve 70 decreases sufficiently, the valve 70 will also close (and assume the sealed closed configuration in FIG. 5). Typically, the closed valve 70 has a sufficient resistance to opening so that it can withstand the static head or weight of the fluent material product within the closure body 22 (and any container communicating therewith) unless the exterior ambient pressure is lowered sufficiently (as by reducing the pressure on the exterior of the valve 70) or unless the interior pressure is increased within the closure body 22 (as by squeezing the container or otherwise additionally pressurizing the container interior).

Figure 7:
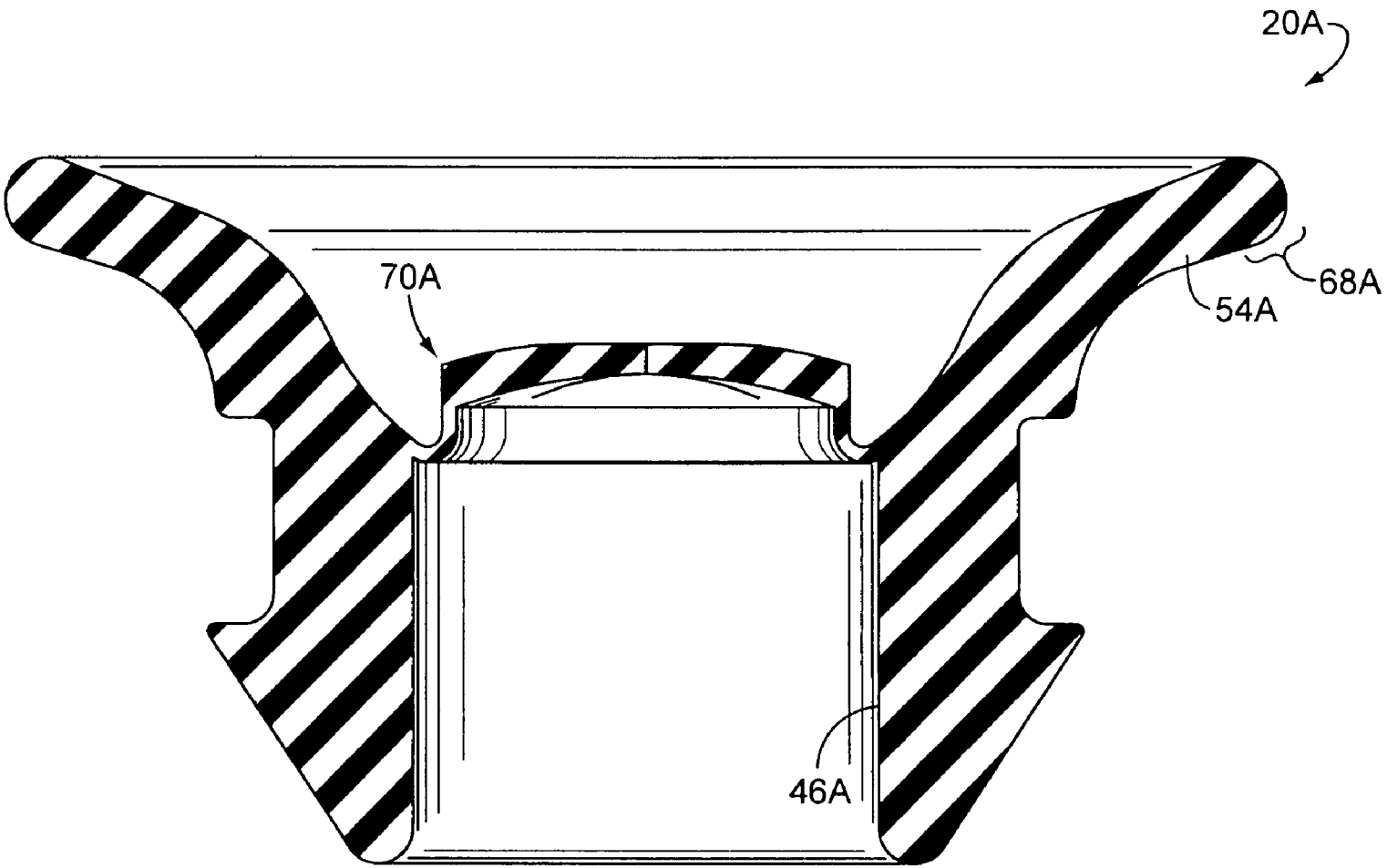
FIG. 7 is a cross-sectional view of a second embodiment of the flow control element of the present invention.

A second embodiment of the flow control element of the present invention is shown in FIG. 7 and is designated therein by the reference number 20A. The second embodiment of the flow control element 20A is similar to the first embodiment of the flow control element 20 illustrated in FIGS. 1–6. The second embodiment 20A differs primarily in that the flange 54A extends somewhat upwardly (or inwardly toward the interior of a housing in which the element 20A would be mounted), as well as laterally. The sealing flange 54A has an outer peripheral surface 68A which is adapted to seal against a portion of a dispensing structure or closure body (not shown) radially outwardly of vent passages (provided through such a dispensing structure or closure body) in generally the same manner as the sealing surface 68 in the first embodiment of the flow control element 20 described above with reference to FIGS. 4–6.

It would also be appreciated that in the second embodiment of the flow control element 20A, the valve 70A is located somewhat higher up in the hub discharge passage 46A. Further, the upper sidewall portion around the discharge passage 46A slopes laterally outwardly away from the valve 70A.

Figure 8:
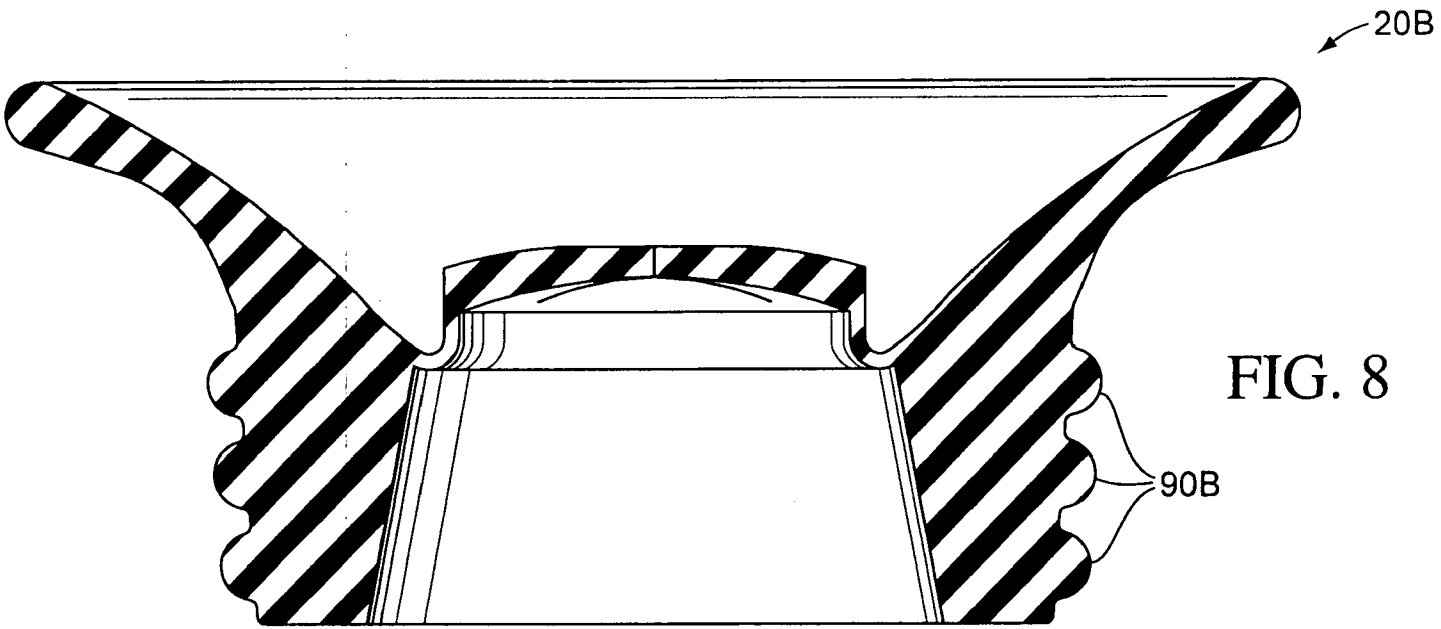
FIG. 8 is a cross-sectional view of a third embodiment of the flow control element of the present invention.

FIG. 8 illustrates a third embodiment of the flow control element 20B. The third embodiment of the flow control element 20B is similar to the second embodiment of the flow control element 20A described above with reference to FIG. 7. However, the third embodiment of the flow control element 20B differs from the second embodiment of the flow control element 20A primarily in the configuration of the structure for attaching the flow control element 20B to a surrounding closure housing (not shown). Whereas the second embodiment of the flow control element 20A is designed to clamp onto the inner edge of a mounting flange of a housing, the third embodiment of the flow control element 20B is adapted to be pushed into a receiving bore in a housing (not shown). To this end, the flow control element 20B includes three, vertically spaced-apart, circumferential, resilient, annular mounting beads 90B. The flow control element 20B can be pushed into a receiving bore of a dispensing structure (e.g., a housing (not shown)), and the beads 90B deform somewhat to form a tight engagement with the surrounding housing.

Figure 9:
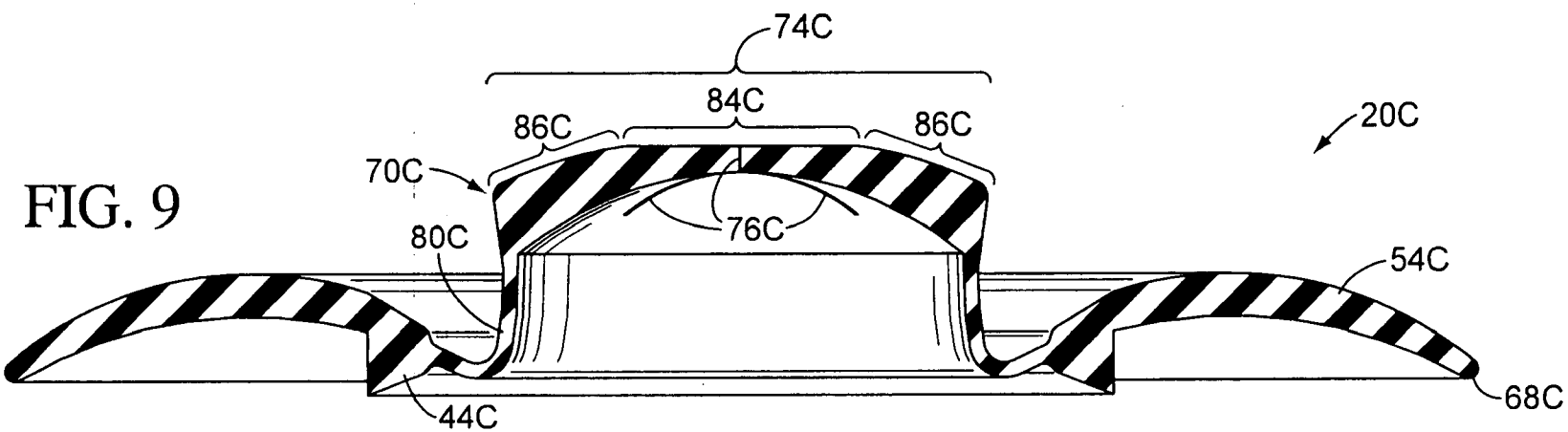
FIG. 9 is a cross-sectional view of a fourth embodiment of the flow control element of the present invention.

A fourth embodiment of the flow control element 20C is illustrated in FIG. 9, and the fourth embodiment of the flow control element 20C is especially suitable for incorporation in an inventive housing to form a dispensing structure 24C shown in FIGS. 10, 11, 12, and 14. The particular dispensing structure 24C illustrated is a dispensing closure 24C which is especially suitable for mounting to the top of a supply system or other source of a fluent material product, including a supply system in the form of a container (not shown). Such a container may have the features described above for the container which may be used with the first embodiment of the dispensing structure or closure 24 illustrated in FIGS. 5 and 6.

Figure 12:
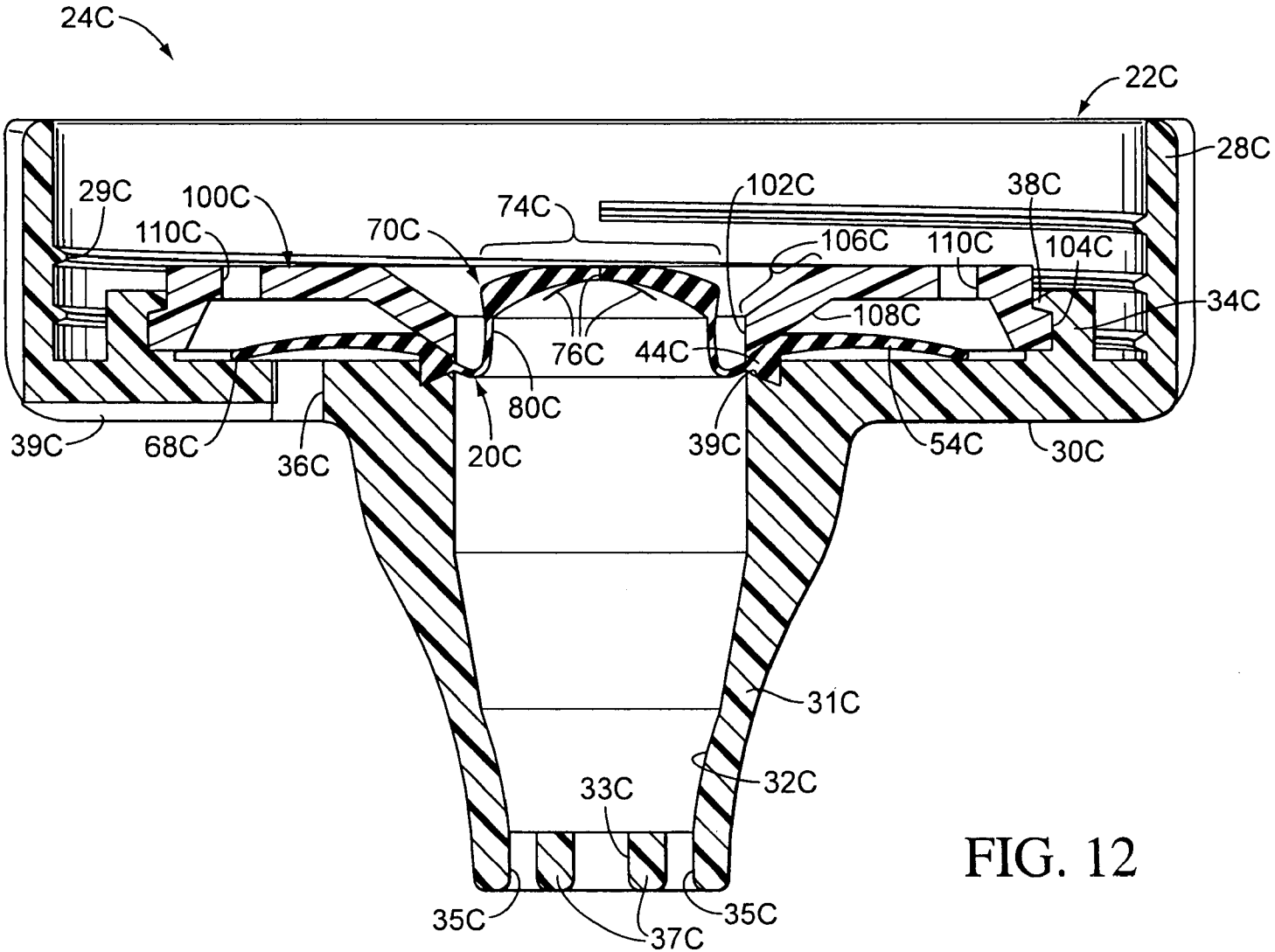
FIG. 12 is a greatly enlarged, cross-sectional view taken generally along the plane 12—12 in FIG. 11.

As shown in FIG. 12, the closure 24C includes a closure body 22C that has a skirt 28C (FIG. 12) defining a conventional internal thread 29C for engaging a mating container thread (not shown) to secure the closure body 22C to the container (not shown). The closure body 22 and the container could also be releasably or non-releasably connected by other means, such as those described above with respect to the first embodiment of the dispensing closure 24 shown in FIGS. 5 and 6.

Figure 10:
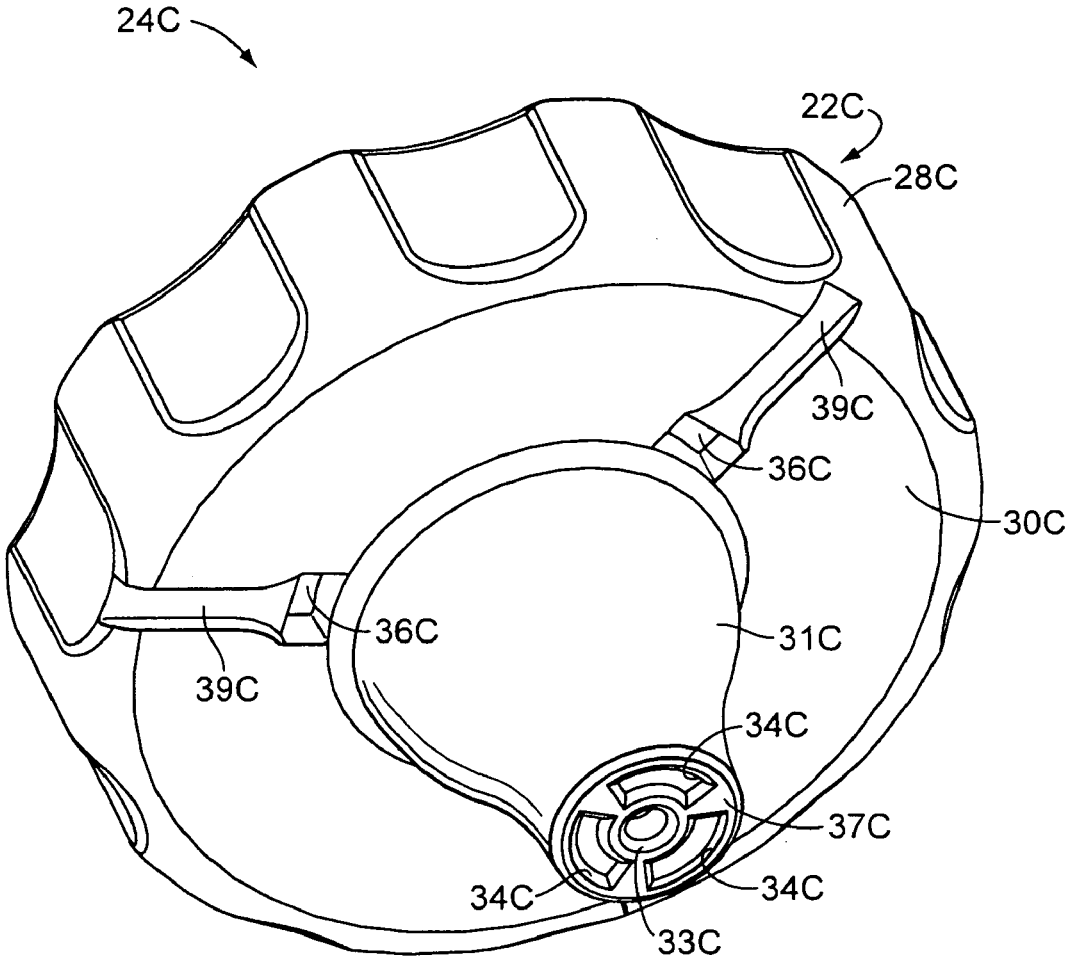
FIG. 10 is a perspective view of the exterior side of a dispensing closure incorporating the fourth embodiment of the flow control element illustrated in FIG. 9.

The closure body 22C defines a radially inwardly extending deck 30C. A radially inward portion of the deck 30C merges with an outwardly extending spout 31C which defines an interior passage or discharge opening 32C. As shown in FIG. 10, the distal end of the spout 31C terminates in a central dispensing aperture 33C and three outwardly located, equally spaced-apart, arcuate, dispensing apertures 35C. The apertures 33C and 35C are defined in an end wall 37C which extends across the discharge opening 32C at the distal end of the spout 31C. The apertures 33C and 35C may be regarded as part of the discharge opening 32C.

As can be seen in FIG. 12, the deck 30C defines an axially inwardly extending annular wall 34C which has a radially inwardly projecting annular retention flange 38C as part of the system for retaining the flow control element 20C as described in detail below. As shown in FIG. 12, the interior side of the deck 30C defines a frustoconical recess or seating surface 39C for receiving a portion of the flow control element 20C as described below in detail.

Figure 11:
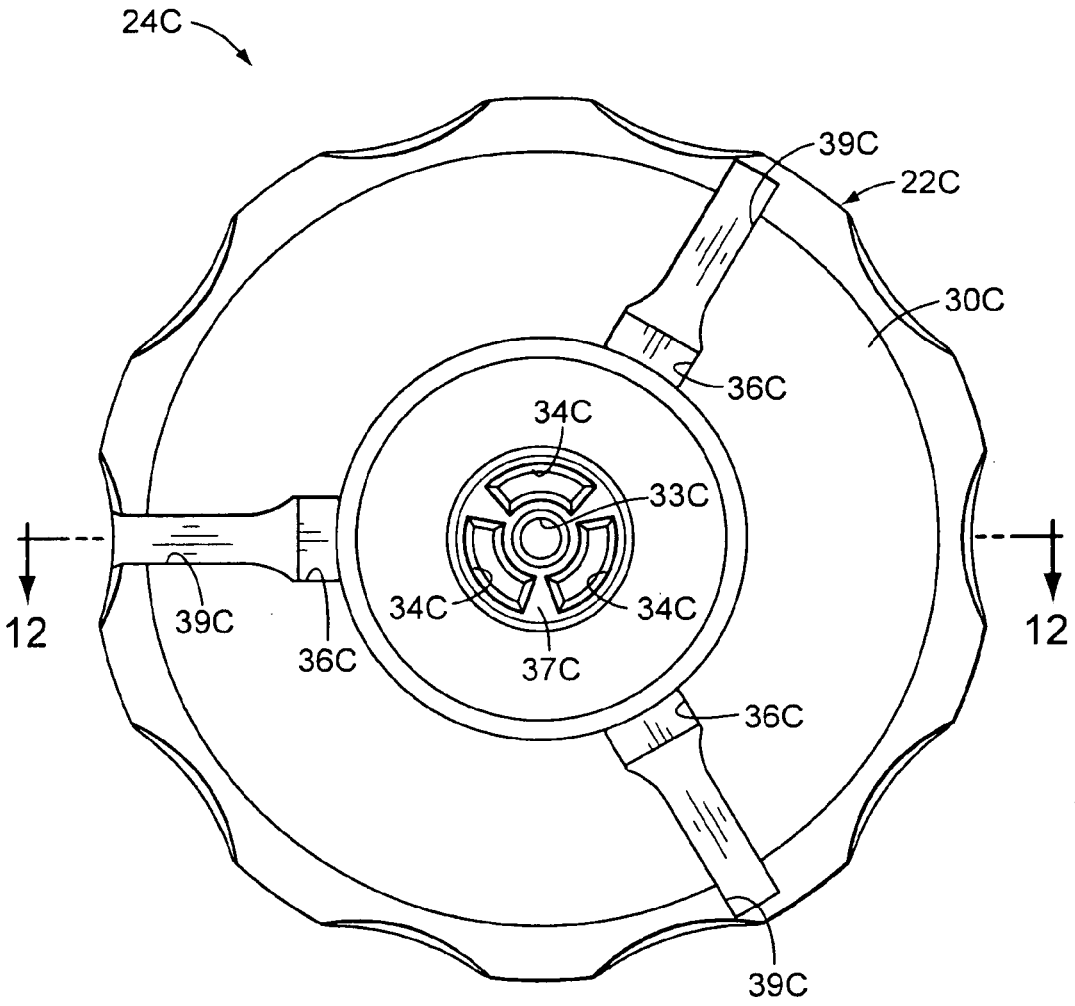
FIG. 11 is a plan view of the exterior side of the dispensing closure illustrated in FIG. 10.

Radially outwardly of the spout 31C, there are three vent passages 36C through the deck 30C as can be seen in FIGS. 10, 11, and 12. The vent passages 36C are equally spaced-apart on a circular locus around the base of the spout 31C. The deck 30C defines three outwardly facing channels 39C (FIG. 10) which each extends from the outer edge of a vent passage 36C to the peripheral edge of the closure body 22C at the skirt 28C.

With reference to FIG. 9, the flow control element 20C includes a stationary anchor portion 44C which generally has the shape of a dove-tail flange (as viewed in cross section in FIG. 9). The stationary anchor portion or flange 44C has a generally annular configuration and extends around a central discharge region across which is disposed a flexible, pressure-openable, self-sealing, slit-type dispensing valve 70C which, in the preferred embodiment illustrated in FIG. 9, is molded as a unitary part of the flow control element 20C. The valve 70C has an interior side for facing generally into the closure body 22C and has an exterior side for facing generally outwardly from the closure body 22C. The interior side of the valve 70C is adapted to be contacted by the fluent material product, and the exterior side of the valve 70C is exposed to the exterior ambient atmosphere or to the atmosphere in any downstream system that might be connected to the closure spout 31C. The valve 70C, and the operating characteristics thereof, are substantially similar to the configuration and operating characteristics of the valve designated by the reference number 3d in the U.S. Pat. No. 5,409,144. The description in that patent is incorporated herein by reference thereto to the extent pertinent and to the extent not inconsistent herewith.

As illustrated in FIG. 9, the valve 70C includes a head or head portion 74C which has an outwardly concave configuration (as viewed from the exterior of the valve 70C when the valve 70C is mounted in the closure body 22C (FIG. 12)). The valve head 74C defines at least one, and preferably two, dispensing slits 76C extending through the valve head 74C to define a normally closed, self-sealing orifice. The preferred form of the valve 70C has two, mutually perpendicular, intersecting slits 76C of equal length. The intersecting slits 76C define four, generally sector-shaped flaps or petals in the head 74C. With reference to FIG. 9, the interior side of the valve head 74C includes a circular, central, flat surface 84C and a peripheral, curved surface 86C around the central, flat surface 84C.

The valve 70C includes a thin skirt 80C (FIG. 9) which extends axially and radially outwardly from the valve head 74C. The outer end portion of the skirt 80C is connected in a unitary manner with the flow control element stationary anchor portion or flange 44C.

Extending radially outwardly from the flow control element stationary anchor portion or flange 44C is an umbrella-shaped sealing flange 54C (FIG. 9). The peripheral outer edge of the umbrella-shaped sealing flange 54C defines a small, arcuate, annular surface portion 68C for contacting and sealingly engaging the interior surface of the closure body deck 30C when the flow control element 20C is mounted within the closure body 22C as illustrated in FIG. 12.

Figure 13:
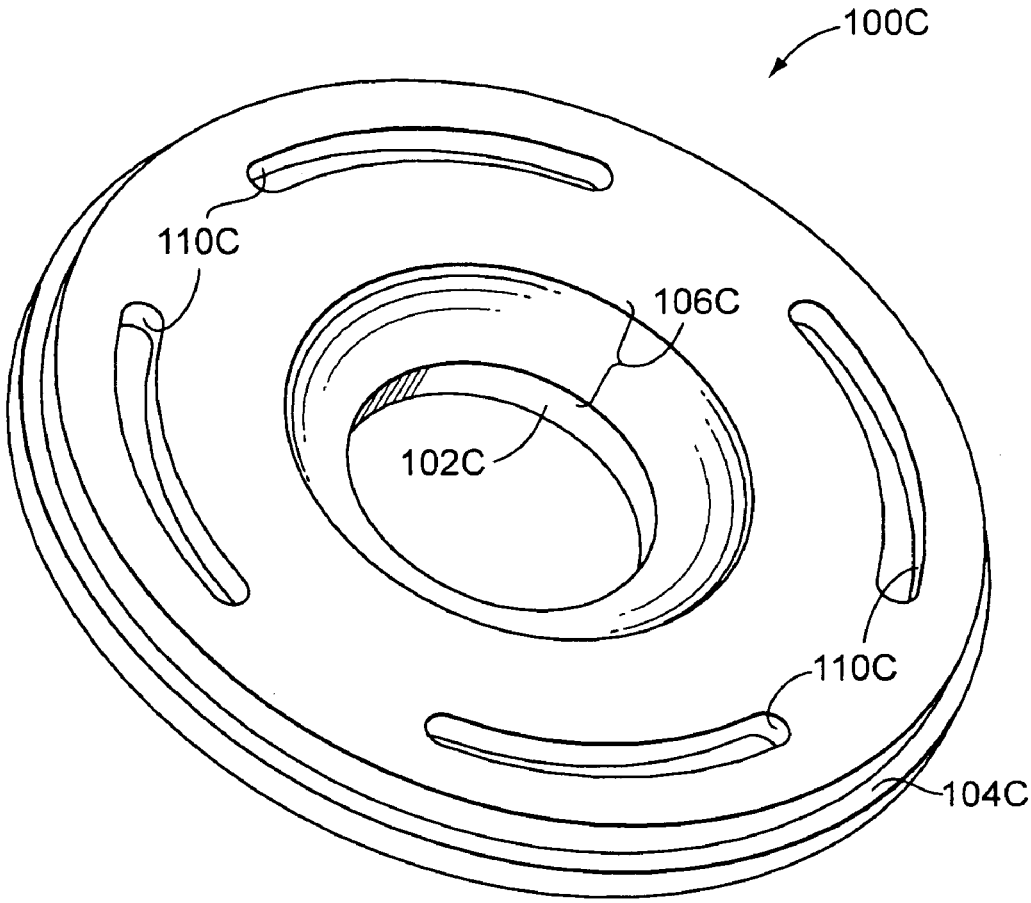
FIG. 13 is a perspective view of the inwardly facing surface of the retainer ring that is employed in the dispensing closure illustrated in FIGS. 10–12.
Figure 14:
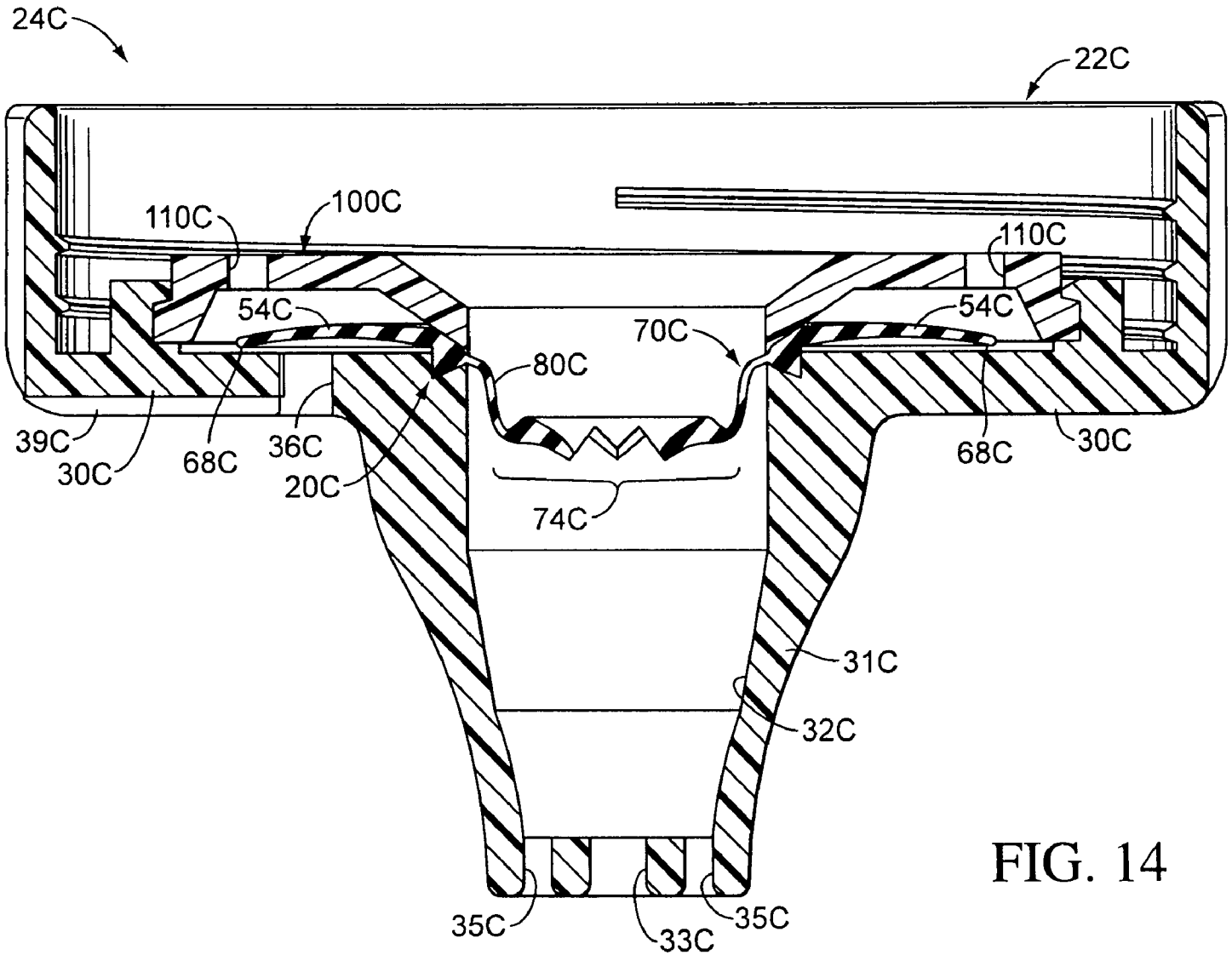
FIG. 14 is a view similar to FIG. 12, but FIG. 14 shows the flow control element in an open configuration for dispensing the fluent material product (not shown) and for accommodating in-venting of another (e.g., second) fluent material (e.g., ambient air) past the flow control element into the interior of the dispensing closure.

The flow control element 70C is mounted within the closure body 22C with a retainer 100C. The anchor portion or flange 44C is disposed on the frustoconical seating surface 39C in the closure body 22C. The retainer 100C is mounted against the interior side of the flow control element 20C to hold the flow control element 20C in place. The retainer 100C has a generally annular configuration as shown in FIG. 13. The retainer 100C defines an inner, central opening 102C for accommodating the valve head 74C. The peripheral, outer edge of the retainer 100C has an annular bead or flange 104C for being snap-fit under the closure body retention flange 38C to hold the retainer 100C securely in place. The retainer 100C has a radially inner portion 106C which angles toward the exterior of the closure and defines a frustoconical surface 108C (FIG. 12) for engaging a mating surface of the stationary anchor portion or flange 44C of the flow control element 20C. The retainer 100C thus securely clamps the flow control element 20C in place in the closure body 22C.

When the flow control element 20C is properly mounted within the closure body 22C as shown in FIG. 12, the outer end of the flow control element sealing flange 54C is bent or deformed slightly (upwardly as viewed in FIG. 12) away from the normal, as-molded configuration (FIG. 9), and the peripheral portion of the sealing flange 54C sealingly contacts the closure body 22C radially outwardly of the vent passages 36C. The sealing contact of the flow control element sealing flange 54C with the closure body 22C is an annular region of contact which occurs between the inside surface of the closure body 22C and the small, annular surface portion 68C (FIGS. 9 and 12) of the flow control element sealing flange 54C. The configuration of the flow control element sealing flange 54C and the resilient nature of the material from which the flow control element 20C is made results in the sealing flange 54C being normally biased against, and in sealing contact with, the closure body 22C so as to normally prevent the exterior ambient fluent material (e.g., air) from flowing past the flow control element 20C into the interior of the closure body 22C.

The retainer 100C defines a plurality of arcuate slots or apertures 110C. FIG. 13 shows a preferred arrangement wherein there are four such slots 110C equally spaced on a circular locus in the retainer 100C. The slots 110C are arranged to be located generally above the peripheral edge of the control element sealing flange 54C when the flow control element 20C is clamped in place by the retainer 100C.

The closure 24C is especially suitable for use with a container (not shown) that contains a liquid to be dispensed into a person's mouth. The person can place the closure spout 31C in the mouth, and then suck on the spout 31C to reduce the pressure within the spout opening or discharge passage 32C. When a sufficient pressure differential exists across the closed valve 70C (FIG. 12), the valve head 74C will move to the open configuration (FIG. 14) in substantially the same manner as described above with respect to the first embodiment of the flow control element valve 70 illustrated in FIGS. 5 and 6. The fluent material within the container to which the closure 22C is attached can then be discharged through the open valve 70C.

If the walls of the container are flexible and resilient, or flexible and collapsible, the discharge of the liquid or other fluent material through the open valve 70C can be assisted by squeezing the walls of the container (not shown). The discharge of the fluent material product will be also assisted by the in-venting of any fluent material in the exterior environment (e.g., ambient air) which vents through the closure 24C into the container. Such in-venting of exterior fluent material will occur if the pressure inside the container and closure 22C is sufficiently less than the pressure of the exterior ambient environment so that the fluent material in the exterior ambient environment will act on the flow control element sealing flange 54C and overcome the bias of the flange 54C against the inside of the closure body deck 30C. A sufficiently large pressure differential will force the flange 54C upwardly (as viewed in FIG. 14) to the position illustrated in FIG. 14, so that the exterior ambient fluent material (e.g., air) can flow through the vent passages 36, around the upwardly displaced sealing flange 54C, through the retainer apertures 110C, and into the interior of the closure body 22C for communicating with the interior of the container (not shown). This will permit the incoming ambient fluent material to occupy the interior volume previously occupied by the discharging fluent material product.

This in-venting of exterior ambient fluent material is especially advantageous when the closure 24C is used on a rigid wall container that prevents the user from squeezing the container to force the fluent material product out through the valve 70C. The in-venting of the exterior ambient fluent material can occur during the discharge of the fluent material product out through the valve 70C, although the fluent material product may discharge for a longer period of time than the length of time during which the sealing flange 54C is in the open position. However, the unique design permits in-venting to occur in many applications at least during part of the time that the fluent material product is being discharged out through the open valve 70C. As a result of the in-venting of exterior ambient fluent material (e.g., air), the discharge of the fluent material product may flow out in a more steady discharge stream and is less likely to be temporarily interrupted.

In all of the illustrated embodiments of the valve 70, 70A, 70B, and 70C, it is preferable that the valve close automatically when the pressure differential across the open valve drops below a predetermined amount. If the valve has been designed to be flexible enough to accommodate inward movement of the valve petals (e.g., petal 77 in FIG. 2), then the valve petals can continue moving inwardly from the closed position (e.g., from the closed position shown in FIGS. 2 and 4). This causes the valve to open inwardly as the pressure differential gradient direction reverses and the pressure on the valve head exterior surface exceeds and the pressure on the valve head interior surface by a predetermined amount—a situation that can occur if the closure is mounted to a container having a flexible, resilient wall which has been squeezed inwardly by the user and which, upon release by the user, returns to its outward, normal, unstressed configuration to thereby draw a partial vacuum in the container. The partial vacuum can be relieved, and the interior pressure equalized with the exterior pressure, by the exterior ambient fluent material (e.g., air) flowing in a reverse direction through the valve (70, 70A, 70B, and 70C) as well as through the vent passages (e.g., 36 and 36C) past the flow control element sealing flange (54, 54A, and 54C).

When the inventive flow control element of the present invention (e.g., element 20, 20A, 20B, and 20C) is combined with a dispensing structure (such as a closure) having vent passages, the element has the capability to simultaneously dispense a fluent material product out of the dispensing structure and vent air (or other ambient fluent material) into the dispensing structure. The flow control element works well in systems that have pumps in line with the flow control element for creating suction on the exterior side of the flow control element valve. The flow control element also works well with bottles and other containers which have highly flexible, resilient walls.

The flow control element works well with systems that require a substantially continuous flow without venting through the discharge valve. The flow control element of the present invention eliminates the need for separately mounted vent valves that might be employed.

The preferred configuration of the flow control element sealing flange (e.g., flange 54, 54A and 54C) can provide a substantially leak-free system by utilizing a minimal surface contact area between the sealing flange and the housing or closure in which the flow control element is mounted.

The flow control element can be designed for self-retention (e.g., flow control elements 20, 20A, and 20B), or for retention by a separate retaining ring (flow control element 20C and retaining ring 100C), or by other mechanical means, including swaging, coining, ultrasonic welding, etc.

The term "housing" as used herein (including in the appended claims) can include a container as described with respect to some illustrated examples, and the term "housing" can also include other suitable structures which contain, or which are part of a supply system that contains, a fluent material product that is to be discharged (i.e., dispensed) through the flow control element.

It will be readily apparent from the foregoing detailed description of the invention and from the illustrations thereof that numerous variations and modifications may be effected without departing from the true spirit and scope of the novel concepts or principles of this invention.

What is claimed is:

1. A flow control element adapted for operatively cooperating with a housing to discharge a fluent material product through a discharge opening in the housing to the exterior of the housing while venting a fluent material from the exterior ambient environment into the housing interior through a vent passage in the housing, said flow control element comprising:

(A) a stationary anchor portion that extends around a discharge region and that can be mounted in a housing at the discharge opening;

(B) a deflectable sealing flange that (1) extends laterally from and around said stationary anchor portion;

(2) defines a sealing surface facing generally in the direction away from the interior of the housing when said flow control element is in operative cooperation with the housing, and (3) is adapted to be resiliently biased for sealingly contacting a part of the housing to prevent discharge of said fluent material product through the housing vent passage when said flow control element is in operative cooperation with the housing; and (C) a flexible, pressure-openable, self-sealing, slit-type valve that (1) is connected to said stationary anchor portion and is located across said discharge region of said stationary anchor portion, (2) is normally closed to prevent discharge of said fluent material, and (3) can open in response to a pressure differential to permit the discharge of fluent material product through said valve while said sealing flange can be deflected by a pressure differential toward the interior of the housing when said flow control element is in operative cooperation with the housing.

2. The flow control element in accordance with claim 1 in which said flow control element sealing flange sealing surface is an annular, flat surface that is adapted for sealing between the fluent material product on the interior of the housing and the exterior ambient environment fluent material wherein the exterior ambient environment fluent material is air.

3. The flow control element in accordance with claim 1 in which said stationary anchor portion is a generally annular mounting flange for being mounted in a housing.

4. The flow control element in accordance with claim 1 in which said stationary anchor portion is a generally annular hub for being mounted in a housing; and said discharge region is a discharge passage through said annular hub.

5. The flow control element in accordance with claim 1 further in combination with a housing to define a dispensing structure wherein the housing has a central discharge opening and a vent passage.

6. The flow control element in combination with said housing in accordance with claim 5 in which said flow control element and said housing are separate parts that are mechanically mated together to define said dispensing structure.

7. The flow control element in combination with said housing in accordance with claim 6 in which said housing has an interior surface and an exterior surface, said housing discharge opening and vent passage each extend between said housing interior and exterior surfaces, and the housing vent passage is located laterally beyond the housing discharge opening; and said flow control element is disposed across said housing discharge opening and is mounted in said housing so that said sealing flange is biased against said interior surface of said housing laterally outwardly of said vent passage.

8. A flow control element for operatively cooperating with a housing, said flow control element comprising:

a hub for being mounted in a housing and having a first end, and a second end, and a discharge region that is defined by a central discharge passage through said hub;

a deflectable sealing flange that (a) is adjacent said second end of said hub, (b) extends laterally from and around said hub, (c) defines a sealing surface facing in the direction toward said hub first end, and (d) is adapted to be resiliently biased for sealingly contacting a part of a housing when said element is in operative cooperation with the housing; and a flexible, pressure-openable, self-sealing, slit-type valve that (1) is connected to said hub and located across said hub central discharge passage, (2) is normally closed to occlude said hub central discharge passage and prevent discharge of a fluent material product, and (3) can open in response to a pressure differential to permit the discharge of said fluent material product through said valve in the direction toward said hub first end while said sealing flange can be deflected by a pressure differential in the direction away from said hub first end when said flow control element is in operative cooperation with the housing.

9. A dispensing structure comprising:

(A) a housing defining (1) a discharge opening; and (2) a vent passage laterally beyond said discharge opening; and (B) a flow control element that is mounted in said housing and that includes (1) a hub that (a) is mounted in said housing at said discharge opening (b) has a first end, (c) has a second end, and (d) defines a discharge region in the form of a central discharge passage through said hub;

(2) a deflectable sealing flange that (a) is adjacent said second end of said hub, (b) extends laterally from and around said hub, (c) defines a sealing surface facing in the direction toward said hub first end, and (d) is resiliently biased for sealingly contacting a part of said housing laterally beyond said vent passage; and (3) a flexible, pressure-openable, self-sealing, slit-type valve that (1) is connected to said hub and located across said hub central discharge passage, (2) is normally closed to occlude said hub central discharge passage and prevent discharge of a fluent material product, and (3) can open in response to a pressure differential to permit the dispensing of said fluent material product through said valve in the direction toward said hub first end while said sealing flange can be deflected away from sealing contact with said part of said housing by a pressure differential to permit flow of exterior ambient fluent material into the interior of said housing.

10. A flow control element for operatively cooperating with a housing, said flow control element comprising:

a stationary mounting flange that is adapted for being mounted in a housing and that extends around a discharge region;

a deflectable sealing flange that (a) extends laterally from and around said stationary mounting flange, (b) defines a sealing surface facing generally in the direction away from the interior of a housing when said flow control element is in operative cooperation with the housing, and (c) is adapted to be resiliently biased for sealingly contacting a part of the housing when said flow control element is in cooperation with the housing; and a flexible, pressure-openable, self-sealing, slit-type valve that (a) is connected to said stationary mounting flange and is located across said discharge region, (b) is normally closed to occlude said discharge region and prevent discharge of a fluent material product, and (c) can open in response to a pressure differential to permit the discharge of said fluent material product through said valve while said sealing flange can be deflected by a pressure differential toward the interior of the housing when said flow control element is in operative cooperation with the housing.

11. A dispensing structure comprising:

(A) a housing defining (1) a discharge opening; and (2) a vent passage laterally beyond said discharge opening; and (B) a flow control element that includes (1) a stationary mounting flange that extends around a central discharge region and that is mounted in said housing at said discharge opening;

(2) a deflectable sealing flange that (a) extends laterally from and around said stationary mounting flange, (b) defines a sealing surface facing generally in the direction away from the interior of said housing, and (c) is resiliently biased for sealingly contacting a part of the housing radially outwardly of said vent passage; and (3) a flexible, pressure-openable, self-sealing, slit-type valve that (a) is connected to said mounting flange and is located across said central discharge region, (b) is normally closed to occlude said central discharge region and prevent discharge of a fluent material product, and (c) can open in response to a pressure differential to permit the discharge of said fluent material product through said valve while said sealing flange can be deflected away from sealing contact with said part of said housing by a pressure differential to permit flow of exterior ambient fluent material into the interior of said housing.

* * * * *